United States Patent [19]

Solomon

[11] Patent Number: 4,518,946

[45] Date of Patent: May 21, 1985

[54] AUDIO-VISUAL ALARM DEVICE WITH TRANSLUCENT COVER

[75] Inventor: Dennis R. Solomon, Wallasey, England

[73] Assignee: CQR Security Systems Limited, Wallasey, England

[21] Appl. No.: 379,873

[22] Filed: May 19, 1982

[51] Int. Cl.[3] ..... G08B 27/00

[52] U.S. Cl. ..... 340/326; 340/327; 340/331

[58] Field of Search ..... 340/321, 326, 327, 331, 340/333, 384 E, 815.21, 815.22, 815.3

[56] References Cited

U.S. PATENT DOCUMENTS

| | | | |
|---|---|---|---|
| 2,572,400 | 10/1951 | Slocum | 340/327 |
| 2,723,389 | 11/1955 | Hallerberg | 340/327 |
| 2,730,704 | 1/1956 | Warren | 340/327 |
| 2,731,627 | 1/1956 | Herbst | 340/327 |
| 3,742,480 | 6/1973 | Hoecker | 340/326 |
| 4,200,823 | 4/1980 | Keeran | 340/331 |
| 4,241,332 | 12/1980 | Farque | 340/327 |
| 4,254,405 | 3/1981 | Wenzlaff | 340/321 |

FOREIGN PATENT DOCUMENTS

| | | | |
|---|---|---|---|
| 597657 | 4/1978 | Switzerland | 340/326 |
| 403024 | 12/1933 | United Kingdom . | |
| 629842 | 11/1949 | United Kingdom . | |
| 1318891 | 5/1973 | United Kingdom . | |

*Primary Examiner*—James J. Groody
*Assistant Examiner*—Michael F. Heim
*Attorney, Agent, or Firm*—Bacon & Thomas

[57] ABSTRACT

An alarm device comprises a bell alarm 12 and a flashing light warning means 11, both encased in a housing 13 formed of translucent material. The device of the invention incorporates both an audible and visual alarm means in a single device and electrical circuit means are provided whereby the audible alarm may be turned off after a preselected time period and the visual warning means then comes into operation. Alternatively, both the audible alarm and the visual warning alarm can both operate together initially and then, after a preselected time, the audible alarm is turned off, leaving the visual warning means in operation.

The arrangement of the invention is substantially maintenance free and vandal-proof and the translucent housing permits the visual warning means to be seen therethrough, without disclosing the workings of the device.

4 Claims, 1 Drawing Figure

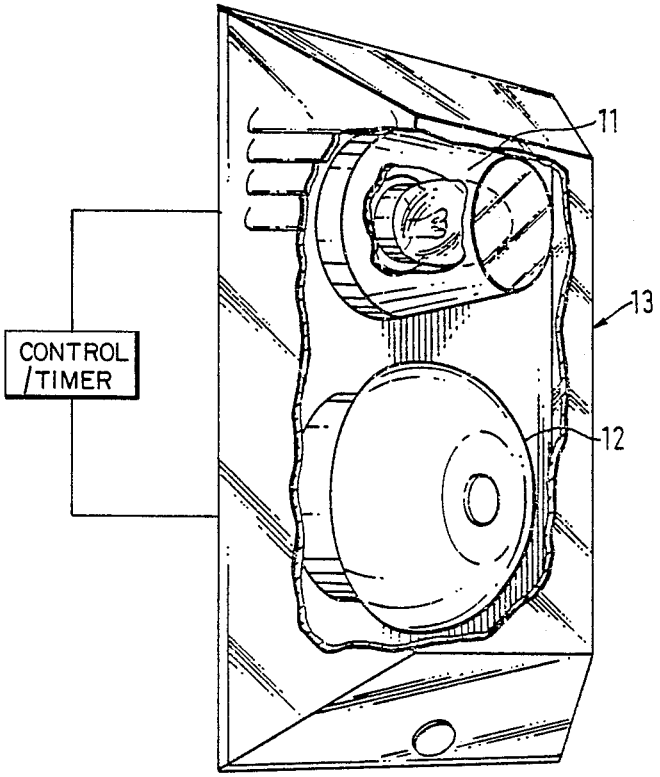
CONTROL
/TIMER
11
13
12

AUDIO-VISUAL ALARM DEVICE WITH TRANSLUCENT COVER

The present invention relates to an alarm device and more particularly is concerned with so-called "bell-box"alarm systems.

For security of homes and commercial premises, alarm systems of many and various kinds are provided. Generally, the alarm bell associated with such systems is provided on an outside wall of the home or commercial premise. The alarm bell is normally encased in a metal housing. Upon an intruder entering the home or premise, the alarm device is triggered off and the alarm bell rings.

A problem which arises in connection with such devices, is the noise factor associated therewith, particularly in those cases where a false alarm has occurred and the owner of the home or premise cannot be contacted.

It is proposed to provide an arrangement which, in addition to an alarm bell also includes a light, the arrangement being such that, in one embodiment, when the alarm bell is turned off after a preselected period of time the light then comes into operation. Such arrangement will enable the police to ascertain the location of the burglary or false alarm and to take appropriate action, without any other persons being affected by the continuous ringing of the alarm bell.

Furthermore in accordance with the invention, and in an attempt to combat vandalism, an alarm device is provided in which both the alarm bell and the light are enclosed within a housing. Such housing should be formed of material which will permit the light to be seen therethrough but which does not permit the workings of the alarm device to be seen.

Such arrangements provide a compact alarm device with all the integers thereof being enclosed within a single housing.

According to the present invention there is provided an alarm device comprising a housing containing a audible alarm means and a visual warning means, at least a portion of said housing being formed of translucent material, and means for operating each of said audible alarm means and said visual warning means.

In a preferred embodiment of the present invention, the audible alarm means is in the form of a bell alarm, the visual warning means is in the form of a light, preferably a flashing light, and the housing is preferably formed of translucent plastics material.

By use of the arrangement in accordance with the invention, it can be seen that a compact arrangement is enclosed within the housing, a portion of the housing being formed of material which will permit the visual warning means to be seen therethrough.

In one embodiment of the present invention, the means for operating the audible alarm and the visual alarm comprises preferably an electrical control and timer means which includes a cut-out arrangement for turning off the audible alarm after a preselected time period, e.g. ten minutes, and means for then bringing the visual warning means into operation.

In an alternative embodiment, the control and timer means operates both the audible alarm means and the visual warning means upon triggering off of the alarm device and the cut-out arrangement turns off the audible alarm means after a preselected time period leaving the visual warning means in operation.

The electrical control and timer circuit utilized will comprise any conventional arrangement for operating the alarm device in the desired sequence, and since such description of such arrangements are well known in the art, no detailed circuit arrangements will be given.

It is to be understood that the electrical means for operating the audible alarm means and the visual warning means can be located either within the housing or exterior thereof.

By the preferred use of a housing which is formed completely of transluscent plastics material, the alarm device of the present inventin is rendered rust-free and covers both the audible alarm and the visual warning means and accordingly, the maintenance requirements therefore are substantially reduced as compared with a metal housing enclosing an audible alarm as well as a modified arrangement wherein the visual warning means will be provided separate from the metal housing and the audible alarm.

The present invention will be further illustrated by way of example, with reference to the accompanying drawing in which the single FIGURE is a perspective view of an alarm device in accordance with the invention, part of the housing being cut away to show the interior of the device.

As illustrated, the alarm device comprises a translucent plastics material housing 13, encasing an audible alarm, in the form of a bell alarm 12, and a visual alarm, in the form of a flashing light 11. Conventional electrical circuitry, not shown, is provided to operate the bell alarm 12 and the flashing light 11.

Upon triggering off of the alarm device in one embodiment, the electrical control and timer means operates the bell alarm 12. After a pre-selected time period, the bell alarm 12 is turned off and the flashing light 11 then becomes operative. In an alternative embodiment both the flashing light 11 and the bell alarm 12 become operative initially, the bell alarm 12 being turned off after a pre-selected time period, and the flashing light 11 remaining operative.

The translucent nature of the housing 13 enables the flashing light 11 to be seen, when operative, however, the workings of the alarm device cannot be seen.

It can thus be seen that the alarm device in accordance with the present invention exhibits many substantial advantages over prior art devices and permits an arrangement to be provided whereby the audible alarm can be turned off whilst still leaving the alarm operative.

We claim:

1. An alarm device comprising a housing enclosing an audible alarm means and a visual, light emitting warning means, said housing being formed of translucent material that shields the audible alarm and visual warning means from direct viewing while permitting the light emitted by the visual warning means to be transmitted therethrough, and means for operating each of said audible alarm means and said visual warning means.

2. An alarm device as recited in claim 1 in which said audible alarm means is in the form of a bell alarm.

3. An alarm device as recited in claim 1, in which the means for operating the audible alarm means and the visual warning means comprises an electrical control and timer means for turning off the audible alarm means after a pre-selected time period, and for then bringing the visual warning means into operation.

4. An alarm device as recited in claim 1, in which the means for operating the audible alarm and the visual warning means comprises an electrical control and timer means which operates both the audible alarm means and the visual warning means upon triggering off of the alarm device and turns off the audible alarm means after a pre-selected time period, thereby leaving the visual warning means in operation.

* * * * *